US010617589B2

(12) United States Patent
Park et al.

(10) Patent No.: US 10,617,589 B2
(45) Date of Patent: Apr. 14, 2020

(54) WALKING ASSISTANCE ROBOT LOAD COMPENSATION SYSTEM AND WALKING TRAINING APPARATUS HAVING SAME

(71) Applicant: P & S MECHANICS CO., LTD., Seoul (KR)

(72) Inventors: Kwang Hun Park, Seoul (KR); Dong Chan Lee, Seongnam-Si (KR); Ki Hong Lee, Bucheon-Si (KR); Jong Hyeok Kim, Gwangmyeong-Si (KR)

(73) Assignee: P & S MECHANICS CO., LTD. (KR)

( * ) Notice: Subject to any disclaimer, the term of this patent is extended or adjusted under 35 U.S.C. 154(b) by 508 days.

(21) Appl. No.: 15/324,678

(22) PCT Filed: Sep. 25, 2014

(86) PCT No.: PCT/KR2014/008938
§ 371 (c)(1),
(2) Date: Jan. 6, 2017

(87) PCT Pub. No.: WO2016/006761
PCT Pub. Date: Jan. 14, 2016

(65) Prior Publication Data

US 2017/0202726 A1 Jul. 20, 2017

(30) Foreign Application Priority Data

Jul. 7, 2014 (KR) ..... 10-2014-0084588

(51) Int. Cl.
*A61H 1/02* (2006.01)
*A63B 22/02* (2006.01)
*A61H 3/00* (2006.01)

(52) U.S. Cl.
CPC ..... *A61H 3/00* (2013.01); *A61H 1/024* (2013.01); *A61H 1/0229* (2013.01);
(Continued)

(58) Field of Classification Search
CPC ..... A61H 1/0229
See application file for complete search history.

(56) References Cited

U.S. PATENT DOCUMENTS 5,273,502 A * 12/1993 Kelsey ..... A61H 1/0229 482/66
5,626,540 A * 5/1997 Hall ..... A61H 1/0229 482/69

(Continued)

FOREIGN PATENT DOCUMENTS

KR 100658981 B1 12/2006
KR 20100090395 8/2010

(Continued)

OTHER PUBLICATIONS

International Search Report for PCT/KR2014/008938, dated Mar. 24, 2015.
Written Opinion for PCT/KR2014/008938, dated Mar. 24, 2015.

*Primary Examiner* — Jacqueline Woznicki
(74) *Attorney, Agent, or Firm* — Renaissance IP Law Group LLP

(57) ABSTRACT

The present invention relates to a walking assistance robot load compensation system which cancels out the load of a walking assistance robot worn by a walking trainee, the walking assistance robot load compensation system comprising a dynamic compensation part compensating for changes to a dynamic load according to the displacement or the inertia of the walking assistance robot, the dynamic compensation part, which may compensate for a changing dynamic load of the walking assistance robot, comprising: a first plate which is movable in association with the displacement or inertia; a second plate which is spaced apart from the first plate and is movable in association with the walking assistance robot; a connection wire which is connected to the first and second plates and movable in association with the (Continued)

first plate and the second plate; and a dynamic compensation unit which applies resistance force to the connection wire to suppress changes to the dynamic load of the walking assistance robot.

11 Claims, 4 Drawing Sheets

(52) U.S. Cl.
CPC ..... *A61H 1/0244* (2013.01); *A61H 1/0262* (2013.01); *A61H 1/0266* (2013.01); *A61H 2201/1215* (2013.01); *A61H 2201/164* (2013.01); *A61H 2201/165* (2013.01); *A61H 2201/1659* (2013.01); *A61H 2201/50* (2013.01); *A61H 2201/5061* (2013.01); *A61H 2201/5064* (2013.01); *A61H 2205/10* (2013.01); *A63B 22/02* (2013.01)

(56) References Cited

U.S. PATENT DOCUMENTS

| | | | | |
|---|---|---|---|---|
| 5,667,461 | A * | 9/1997 | Hall | A61H 1/0229 472/15 |
| 5,830,162 | A * | 11/1998 | Giovannetti | A61B 5/1038 601/23 |
| 2003/0153438 | A1 | 8/2003 | Gordon et al. | |
| 2005/0239613 | A1* | 10/2005 | Colombo | A63B 71/0009 482/94 |
| 2006/0229170 | A1* | 10/2006 | Ozawa | A61H 1/003 482/92 |
| 2017/0165145 | A1* | 6/2017 | Aryananda | A61H 3/008 |

FOREIGN PATENT DOCUMENTS

| | | | |
|---|---|---|---|
| KR | 101073525 | B1 | 10/2011 |
| KR | 101074754 | B1 | 10/2011 |
| KR | 20120057081 | A | 6/2012 |
| KR | 101244851 | B1 | 3/2013 |
| KR | 101289005 | B1 | 7/2013 |

* cited by examiner

300 : 310, 320, 330

FIG. 2 Amended
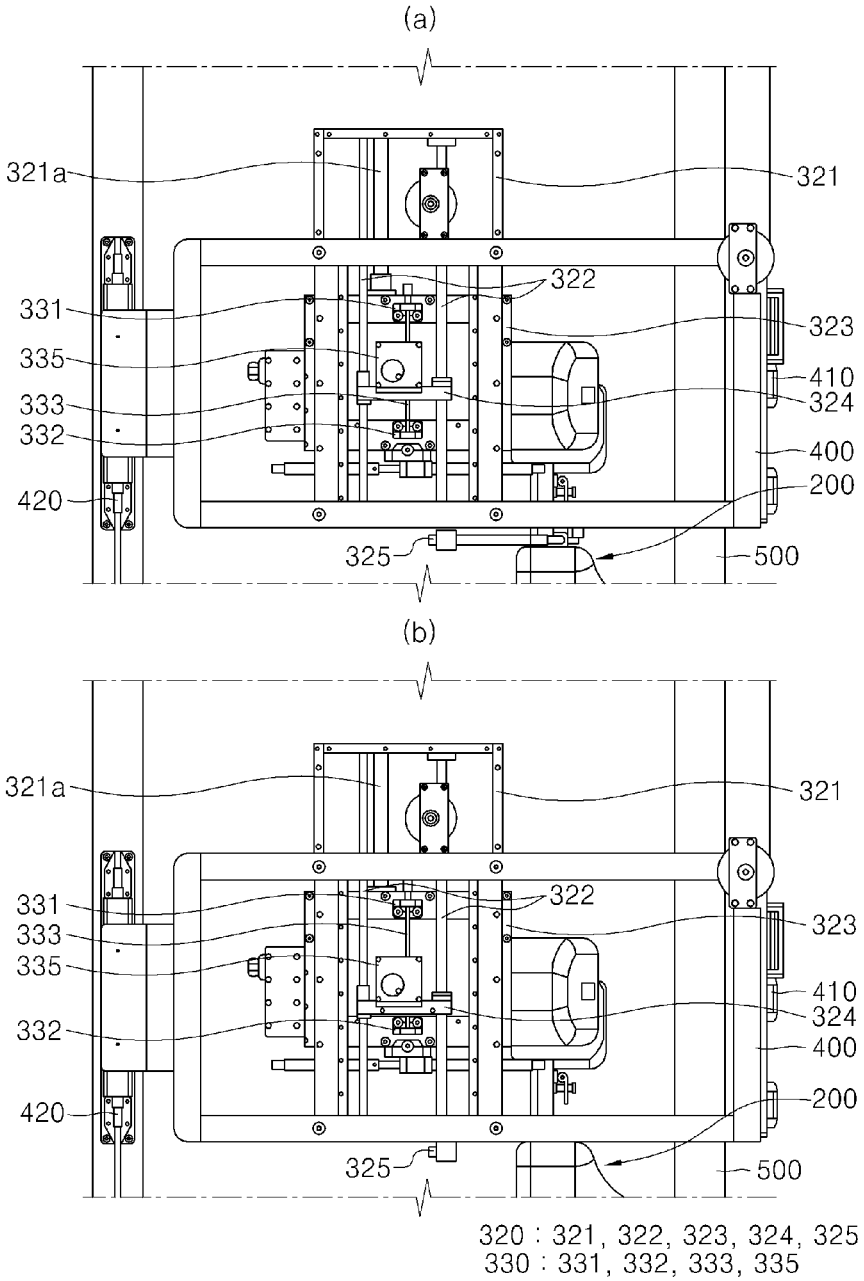

FIG. 3 Amended
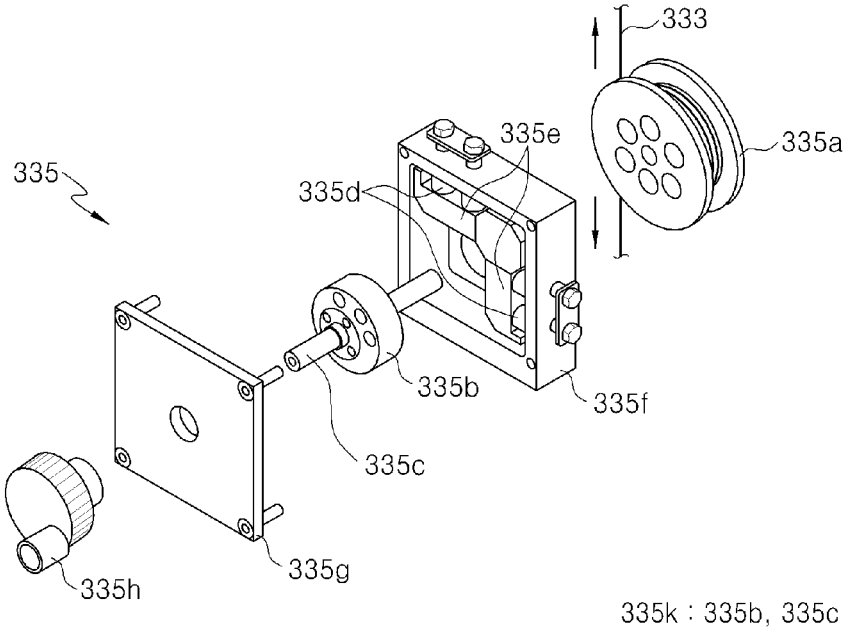

WALKING ASSISTANCE ROBOT LOAD COMPENSATION SYSTEM AND WALKING TRAINING APPARATUS HAVING SAME

CROSS-REFERENCE TO RELATED APPLICATION

This application claims priority to and the benefit of Korean Patent Application No. 10-2014-0084588 filed in the Korean Intellectual Property Office on Jul. 7, 2014, the entire contents of which are incorporated herein by reference.

TECHNICAL FIELD

The present invention disclosed herein relates to a walking assistance robot load compensation system and a walking training apparatus having the same, and more specifically, to a walking assistance robot load compensation system and a walking training apparatus having the same which can compensate for a changes to a dynamic load according to the displacement or the inertia of a walking assistance robot.

BACKGROUND ART

In general, a walking training apparatus is designed for the rehabilitation of patients with numbness symptoms on the lower half of the body as well as patients having difficulties walking normally due to abnormalities in the joints and lack of limb strength.

Most of patients having walking trouble have difficulty moving their own legs by themselves. Therefore, the patients train by bending or moving the legs according to a walking pattern led by a wearable walking training apparatus. However, a walking assistance robot has its own native load. Therefore, conventional walking assistance robots have canceled out their loads via a tractor to prevent patients from feeling the load of the walking assistance robot. However, a conventional tractor of the walking assistance robot cancels the load of walking assistance robot applied to the patients based on the patients being in a static state. Accordingly, since the load of the walking assistance robot is changed in a dynamic manner by the displacement or the inertia of the walking assistance robot when the walking assistance robot moves, the tractor of the walking assistance robot is not able to cancel out a changing dynamic load. Therefore, patients wearing the walking assistance robot do not sense the load in its static state, but patients do sense the changing dynamic load of the walking assistance robot when the walking assistance robot is moving, which leads discomfort to the patents and excessive load on the limb, resulting in an unsafe walking training.

RELATED ART DOCUMENT

Korean registered patent gazette No. 10-1074754

DISCLOSURE

The present invention provides a walking assistance robot load compensation system and a walking training apparatus having the same which minimize the change of a dynamic load according to the displacement the inertia of a walking assistance robot.

Furthermore, the present invention provides a walking assistance robot load compensation system and a walking training apparatus which can perform walking training safely and with no discomfort.

The present invention is a walking assistance robot load compensation system able to cancel out a load of a walking assistance robot worn by a walking trainee. The walking assistance load compensation system comprising a dynamic compensation part compensating for changes to a dynamic load according to the displacement or the inertia of the walking assistance robot, the dynamic compensation part comprising a first plate movable in association with the displacement or the inertia of the walking assistance robot, a second plate, spaced apart from the first plate and movable in association with the first plate, a connection wire connecting the first and the second plates, and a dynamic compensation unit applying resistance force to the connection wire.

The dynamic compensation unit comprises a pulley connected to and rotated by the connection wire, a cam rotated in connection with the pulley, and an elastic body providing frictional force to the cam when rotating.

A rotation axis of the cam is deployed eccentrically from a center of gravity of the cam.

The dynamic compensation unit further comprises a case receiving the cam and the elastic body, a cover sealing the inside of the case, and a lever adjusting position of the cam, wherein lubricant is provided inside of the case.

The elastic body is deployed in two directions crossing at right angles to the rotation axis of the cam.

The walking assistance robot load compensation system further comprises a guide part comprising a guide body; a moving block connected to the first plate and the second plate, and movably connected to the guide body; a guide shaft installed on the guide body; and a fixing member connected to the guide shaft to fix the position of the dynamic compensation unit.

The guide part further comprises a position adjuster for adjusting a position of the fixing member when the dynamic compensation unit is fixed.

The walking assistance robot load compensation system further comprises a static compensation part comprising a wire configured to be connected to the walking assistance robot, and an elasticity unit connected to the wire to apply tensile force constantly to the walking assistance robot.

The elasticity unit comprises a spring balancer.

The present invention is a walking training apparatus, comprising a counter load system applying a counter load to a walking trainee, a walking assistance robot worn on limbs of the walking trainee, and the walking assistance robot load compensation system of any of those previously described which supports the walking assistance robot and compensates for changes to a dynamic load according to the walking assistance robot.

The walking training apparatus further comprises a frame supporting the walking assistance robot, and a connection member deployed between the walking assistance robot load compensation system and the frame to connect the walking assistance robot load compensation system and the frame.

One end of the connection member is hinge-coupled to the frame, and the connection member pivots to move the walking assistance robot to a wearing position of the walking trainee.

The walking training apparatus further comprises a treadmill providing a moving floor face to the walking trainee.

The walking training apparatus further comprises a controller controlling driving of at least one of the counter load system, the walking assistance robot, the treadmill and the walking assistance robot load compensation system to change walking condition of the walking trainee.

Advantageous Effects

A walking training apparatus according to an embodiment of the present invention comprises a dynamic compensation part compensating for changes to a dynamic load according to the displacement or the inertia of a walking assistance robot, thereby minimizing changes of the dynamic load of the walking assistance robot while the walking assistance robot is moving during walking training. Therefore, discomfort or fatigue that patients performing a walking training feel owe to the load of the walking assistance robot is reduced, improving the efficiency of walking training.

Further, the walking assistance robot can have increased stability and the excessive loads on the walking trainee can be reduced, thereby increasing the safety of the walking training. Additionally, the dynamic compensation part is formed in a simple structure to compensate a changing dynamic load of the walking assistance robot, thereby simplifying the apparatus and improving space efficiency.

And the connection member connected to the walking assistance robot pivots to move the walking assistance robot to a wearing position of the walking trainee, thereby the walking trainee being able to attach and detach the walking assistance robot with ease.

DESCRIPTION OF DRAWINGS

FIG. 2 is a drawing showing an operation of a dynamic compensation part according to an embodiment of the present invention;

FIG. 3 is an exploded perspective view showing a dynamic compensation unit according to an embodiment of the present invention.

DETAILED DESCRIPTION

Hereinafter, some embodiments of the present invention will be described in detail with reference to the attached drawing. However, the present invention is not limited to the embodiments shown, but may be implemented with the details varying, and the embodiments are provided only for completing disclosure of the present invention and facilitating for ordinary skilled persons to understand the scope of the invention. For the purpose of detailed description, the drawings may be exaggerated with the same marks on the drawings designating the same elements.

Figure 1:
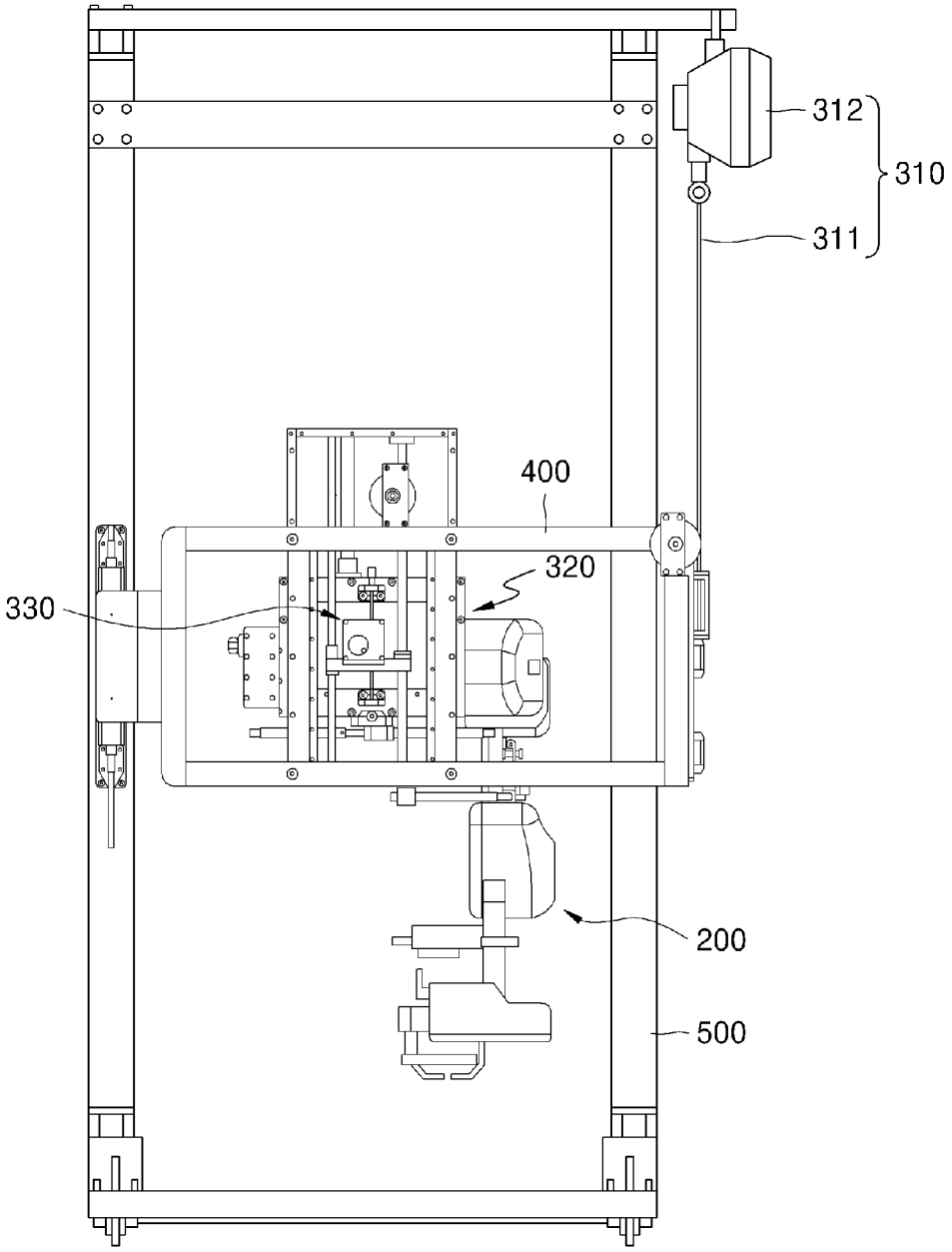
FIG. 1 is a drawing showing a walking assistance robot load compensation system according to an embodiment of the present invention.
Figure 4:
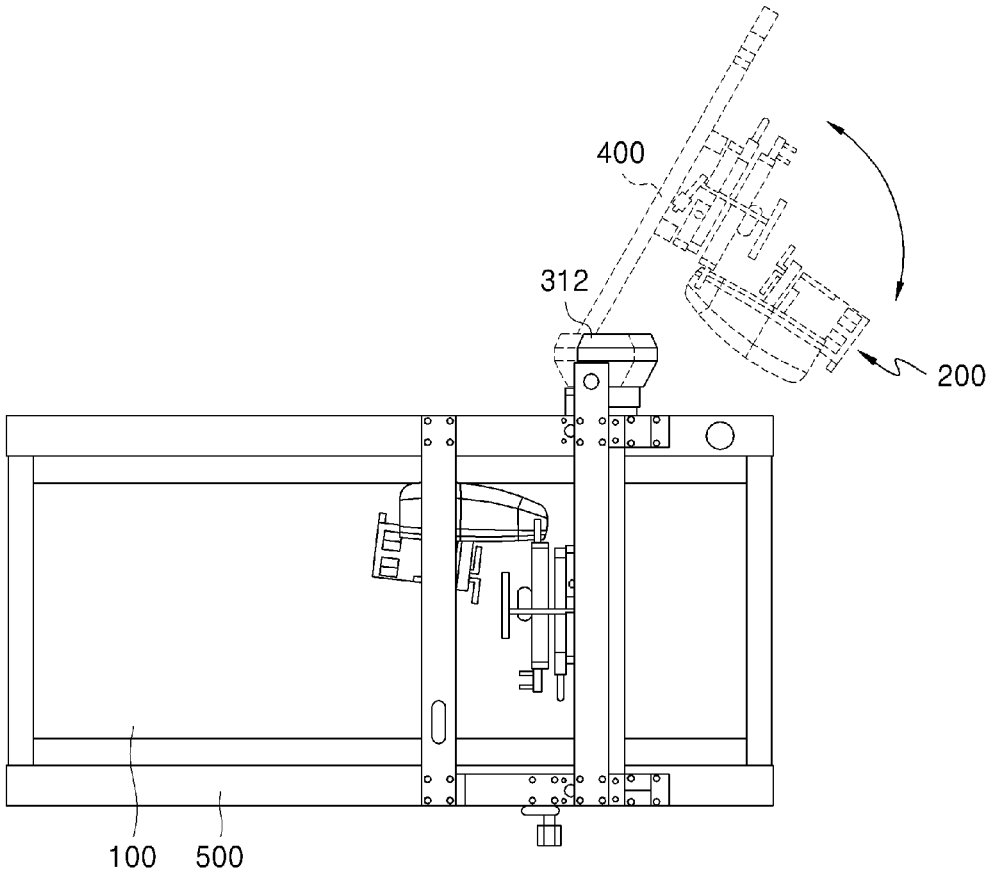
FIG. 4 is a drawing showing an operation of a connection member according to an embodiment of the present invention.

FIG. 1 is a drawing showing a walking assistance robot load compensation system according to an embodiment of the present invention, FIG. 2 is a drawing showing an operation of a dynamic compensation part according to an embodiment of the present invention, FIG. 3 is an exploded perspective view showing a dynamic compensation unit according to an embodiment of the present invention, and FIG. 4 is a drawing showing an operation of a connection member according to an embodiment of the present invention.

Referring to FIG. 1 and FIG. 2, a walking assistance robot load compensation system 300, according to an embodiment of the present invention, is a walking assistance robot load compensation system able to cancel out a load of a walking assistance robot 200 worn by a walking trainee. The walking assistance robot load compensation system 300 includes a dynamic compensation part 330 compensating for changes to a dynamic load according to the displacement or the inertia of the walking assistance robot 200, and may further include a guide part 320 and a static compensation part 310.

The walking trainees are patients with trouble walking, most of whom have difficulty in walking by themselves. Therefore, the walking assistance robot load compensation system 300 supports the walking assistance robot 200 to cancel out the load of the walking assistance robot 200. Accordingly, during walking training, while the walking trainee wears the walking assistance robot 200, the walking trainee can hardly feel the load of the walking assistance robot 200.

However, when the walking trainee performs walking training, the walking assistance robot 200 moves and a displacement of the walking assistance robot 200 occurs, thereby the position of the center of gravity of the walking assistance robot 200 keeps changing. Accordingly, the load of the walking assistance robot 200 cannot be canceled out constantly, thereby the walking trainee senses the changing dynamic load of the walking assistance robot 200. In addition, when the walking assistance robot 200 starts operating, moving the walking assistance robot 200 is difficult since the walking assistance robot 200 has an inertia which resists motion, and when the walking assistance robot 200 is moving, moving the walking assistance robot 200 is easy since it has an inertia which persists in motion.

Accordingly, the force required to move the walking assistance robot 200 changes according to the inertia of the walking assistance robot 200. Thus, when a same force is applied to operate the walking assistance robot 200 from the beginning to the end of the walking training, the walking trainee may sense differences in the change of the dynamic load.

Therefore, the walking assistance robot load compensation system 300 according to an embodiment of the present invention has a dynamic compensation part 330. That is, the dynamic compensation part 330 compensates for changes to the dynamic load of the walking assistance robot 200, according to the displacement or the inertia of the walking assistance robot 200, and thereby suppresses changes to the dynamic load of the walking assistance robot 200.

In order to understand the present invention, the static compensation part 310 and the guide part 320 will be described in further detail. The static compensation part 310 includes a wire 311 connected to the walking assistance robot 200, and an elasticity unit 312 connected to the wire 311 to apply a constant tensile force constantly. One end of the wire 311 may connect to the walking assistance robot 200 and the other end of the wire 311 may connect to the elasticity unit 312. Accordingly, via the wire 311, the elasticity unit 312 may provide a static compensation for the walking assistance robot 200.

The elasticity unit 312 applies a constant tensile force to the walking assistance robot 200. In some embodiments the elasticity unit 312 may be a spring balancer. Accordingly, the elasticity unit 312 may provide a walking assistance robot 200 with the same power even though the walking assistance robot 200 may move to any position such as 100 mm, 500 mm, and 800 mm from the surface. Therefore, when the walking assistance robot 200 moves upwards, the elasticity unit 312 provides static compensation by applying a constant tensile force, thereby allowing the walking assistance robot 200 to be moved vertically with little force. Furthermore, the elasticity unit 312 is not limited to the spring balancer, and in other embodiments a variety of members capable of applying elasticity or tensile force may be used.

The elasticity unit 312 applies a tensile force based on the load of the walking assistance robot 200 before performing walking training with the walking assistance robot 200 at a static state, or at a stop state. Therefore, when walking assistance robot 200 moves for walking training, owing to the displacement or the inertia resisting motion, the walking trainee may sense the load of the walking assistance robot 200 which was canceled out at a stop state. The dynamic load of the walking assistance robot 200 being sensed by the walking trainee may cause a feeling of discomfort to the walking trainee, and may give an excessive load to the walking trainee, causing the walking training to become unsafe. Accordingly, the dynamic compensation part 330 is provided to compensate for changes to the dynamic load of the walking assistance robot 200 according to displacement or the inertia of the walking assistance robot 200, thereby suppressing changes to the dynamic load.

The guide part 320 includes a guide body 321, a moving block 323 which is connected to a first plate 331, a second plate 332, or the walking assistance robot 200. Furthermore, the moving block 323 is movably connected to the guide body 321, a guide shaft 322 installed on the guide body 321, and a fixing member 324. The fixing member 324 is further connected to the guide shaft 322 and the fixing member 324 fixes a position for a dynamic compensation unit 335, and may further include a position adjuster 325. In addition, the guide body 321 may be formed in a shape of plate and may be fixed in a deployed position.

The moving block 323 may be formed in a shape of plate, and one end of the moving block 323 may be connected to the walking assistance robot 200, while the other end of the moving block 323 may be movably connected to the guide body 321. For example, an LM (linear motion) guide 321*a*, which extends in vertical direction, is connected to the guide body 321. The moving block 323, in turn, is connected to the LM guide 321*a* provided to the guide body 321 and may move vertically along the direction the LM guide 321*a* extends in. Accordingly, when the walking assistance robot 200 moves and displacement occurs, the moving block 323 connected to the walking assistance robot 200 may move vertically according to the displacement of the walking assistance robot 200. However, the structure of the guide body 321 and the moving block 323 is not limited as such, but may vary, as well as the method in which the moving block 323 is movably connected to the guide body 321 is not limited as such, but may vary.

The guide shaft 322 may extend in vertical direction and be deployed in a parallel direction to the LM guide 321*a*. Furthermore, the guide shaft 322 may be a plurality of guide shafts. For example, the guide shaft 322 may be a pair of guide shafts. Accordingly, the fixing member 324 can be supported with more stability than when supported by one guide shaft 322.

The fixing member 324 may be formed in a shape of plate and may have both sides of such a plate connected to a pair of guide shafts 322. At upper side of the fixing member 324, the dynamic compensation unit 335 may be deployed and the fixing member 324 can support the dynamic compensation unit 335. Accordingly, the fixing member 324 can fix the position where the dynamic compensation unit 335 is deployed. Therefore, as shown in FIG. 2, even though the moving block 323, the first plate 331, and the second plate 332 connected to the moving block 323 move vertically due to the displacement or the inertia of the walking assistance robot 200, the dynamic compensation unit 335 is fixed in order to apply resistance force to a connection wire 333 which moves vertically in connection with the first plate 331 and the second plate 332. However, the shape of the fixing member 324 is not so limited, and may vary.

The position adjuster 325 can adjust the position on the fixing member 324 where the dynamic compensation unit 335 is fixed. For example, an electromagnetic brake or a manual lever can be used as the position adjuster 325. That is, the fixing member 324 is vertically movable along the extending direction of the guide shaft 322 and is fixed to the position deployed by the position adjuster 325, while the fixing member 324 in turn is fixed to the dynamic compensation unit 335. Accordingly, even though the connection wire 333 moves to any position by due to the displacement or the inertia of the walking assistance robot 200, after moving and fixing the fixing member 324, the dynamic compensation unit 335 can apply resistance force to the connection wire 333.

The dynamic compensation part 330 includes the first plate 331 movable in association with the displacement or the inertia of the walking assistance robot 200, the second plate 332 which is spaced apart from the first plate 331 and is movable, the connection wire 333 connected to the first plate 331 and the second plate 332, and the dynamic compensation unit 335 applying a resistance force to the connection wire 333.

The first plate 331 may be formed in a shape of plate and may be formed in a variety of shapes such as circular plate, rectangular plate, and so on. The first plate 331 may be connected to the moving block 323 or the walking assistance robot 200. Accordingly, when the walking assistance robot 200 moves, the first plate 331 may move vertically along the walking assistance robot 200, or the first plate 331 may be moved along with the moving block 323 moved by the walking assistance robot 200.

The second plate 332 may be formed in a shape of plate and may be formed in a variety of shapes such as circular plate, rectangular plate, and so on. The second plate 332 is spaced apart from the lower side of the first plate 331. And the second plate 332 may be connected to the moving block 323 or the walking assistance robot 200. Accordingly, when the walking assistance robot 200 moves, the second plate 332 may move vertically along with the walking assistance robot 200 or along with the moving block 323 moved by the walking assistance robot 200.

One end of the connection wire 333 is connected to the first plate 331 and the other end is connected to the second plate 332. Accordingly, when the first plate 331 or the second plate 332 moves along with the walking assistance robot 200 or the moving block 323, the connection wire 333 may move vertically together.

Referring to FIG. 3, the dynamic compensation unit 335 includes a pulley 335*a* rotated by the connection wire 333, cam 335*k* 335*c* rotating in connection with the pulley 335*a*, and elastic body 335*d* providing frictional force to the cam 335*k* while rotating, and may further include a case 335*f*, a cover 335*g*, and a lever 335*h*.

The pulley 335*a* may be formed in a shape of circular plate, and may be rotatable on a center axis. A groove is formed on the circumference of the pulley 335*a*, and the connection wire 333 may contact the pulley 335*a* within the groove. Accordingly, while the connection wire 333 moves vertically along the first plate 331, the connection wire 333 may contact and rotate the pulley 335*a*. However, the shape of the pulley 335*a* is not limited as such, but may vary.

The cam 335*k* may include a rotation axis 335*c* connected to the pulley 335*a* to rotate, and a cam part 335*b* provided on the rotation axis 335*c*. The cam part 335*b* may be formed in a shape of circular plate, and the rotation axis 335*c* may be connected to the cam part 335*b* eccentrically from a center of gravity of the cam part 335*b*. Accordingly, rotation radius of one side and the other side of the cam part 335*b* by the rotation axis 335*c* may vary. Therefore, a portion of cam part 335*b* having a larger rotation radius, rotates while compressing the elastic body 335*d* with more pushing the elastic body 335*d* or a contact member 335*e* connected to the elastic body 335*d*, thereby providing a larger frictional force from the elastic body 335*d*. Furthermore, a portion of cam part 335*b* having a smaller rotation radius either does not contact or decreases contact with the elastic body 335*d* or the contact member 335*e* connected to the elastic body 335*d*, thereby removing or reducing the frictional force provided by the elastic body 335*d*.

On the other hand, the cam part may include a protruding part. Accordingly, the rotation radius of the protruding part and that of an unprotruding part of the cam part by the rotation axis 335*c* may differ. Therefore, the protruding part of the cam part provides additional contact to either the elastic body 335*d* or the contact member 335*e* connected to the elastic body 335*d* to rotate with pushing the elastic body 335*d*, which may provide a larger frictional force from the elastic body 335*d*. Furthermore, the unprotruding part of the cam part either does not contact or decreases contact with the elastic body 335*d*, removing or reducing the frictional force provided by the elastic body 335*d*. However, the shape of the cam part is not limited as such, but may vary.

The elastic body 335*d* may be a spring having an elastic force. Further, the elastic body 335*d* may be deployed in one or more in directions crossing at right angles to the rotation axis 335*c* of the cam 335*k*. Accordingly, the elastic body 335*d* may interrupt the rotation of the cam part 335*b* with either direct or indirect contact to either a part having larger rotation radius or a protruding part of the cam part 335*b*. Then, the rotation of the pulley 335*a* connected to the cam 335*k* is interrupted, and a resistance force may be applied to the connection wire 333 moving with contact to the pulley 335*a*.

For example, the elastic body may be deployed in two directions crossing at right angles to the rotation axis 335*c* of the cam 335*k* to be deployed at an upper side and a side part of the cam part 335*b*. Therefore, the part having larger rotation radius or the protruding part of the cam part 335*b* receives a frictional force at a section where the elastic body 335*d* is deployed, and receives no frictional force at a section where the elastic body 335*d* is not deployed, thereby allowing selection of a time point to provide frictional force of the cam part 335*b*. That is, the cam part 335*b* applies force upwards while rotating to compress the elastic body 335*d* at an upper side. Then the compressed elastic body 335*d* provides force to the opposite direction against the force delivered by the cam part 335*b*, that is downwards force may be increased by an elastic force. Accordingly, the force of the elastic body 335*d* is delivered to the cam part 335*b* in another direction to the rotating direction of the cam part 335*b* to interrupt the rotation of the cam part 335*b*. The elastic body 335*d* provided at a side part of the cam part 335*b* also may be compressed by the rotating cam part 335*b*, and may also be stretched, to deliver force to the cam part 335*b* in another direction to the rotating direction of the cam part 335*b*, thereby interrupting the rotation of the cam part 335*b*.

Here, a lever 335*h* for adjusting the position of the cam 335*k* may be provided. The lever 335*h* is connected to the cam 335*k* and rotates the cam part 335*b*, thereby setting up a time point for the cam part 335*b* to be provided with elastic force from the elastic body 335*d*. Accordingly, a starting point for dynamic compensation may be set up according to situation of the walking trainee.

Additionally, when the elastic body 335*d* is deployed in four or three directions the elastic body 335*d* may be miniaturized, thereby making the installation and maintenance of the dynamic compensation unit 335 easier. However, the elastic body is not limited to such, but various members having elastic force such as urethane and so on may be used.

Furthermore, the elastic body 335*d* is provided with a contact member 335*e*. The contact member 335*e* is formed in a shape of plate able to contact the rotating cam part 335*b*. Therefore, the elastic body 335*d* contacts the cam part 335*b* indirectly via the contact member 335*e*, thereby preventing the elastic body 335*d* from being worn out or damaged by the rotating cam part 335*b*.

The case 335*f* includes an inside space for receiving the cam part 335*b* and the elastic body 335*d*, a part of which may be opened. Accordingly, the elastic body 335*d* may be installed on the inner wall of the case 335*f* and the cam part 335*b* may be rotated within the case 335*f*. Furthermore, the cover 335*g* may be provided at an opened part of the case 335*f* to seal up the inside of the case 335*f*. Therefore, if the cam part 335*b*, the elastic body 335*d*, or the contact member 335*e* is damaged, the cover 335*g* may be opened to facilitate easy repair. Furthermore, lubricant is provided inside of the case 335*f*, which may be sealed, to facilitate easy rotation of the cam 335*k* inside of the case 335*f*.

Accordingly, the dynamic compensation unit 335 may interrupt the movement of the connection wire 333 connected to the first plate 331 in the vertically direction due to the walking assistance robot 200 or the moving block 323 contacting to the connection wire 333. That is, in the dynamic compensation unit 335, the elastic body 335*d* applies frictional force to cam 335*k* in another direction to the rotating direction of the cam 335*k*, thereby interrupting the rotation of the cam 335*k*. Therefore, by frictional force applied by the elastic body 335*d*, the rotation of the pulley 335*a* connected to the cam 335*k* is also interrupted, thereby applying resistance between the connection wire 333 and the pulley 335*a*. Then, the movement of the first plate 331 and the second plate 332 in the vertical direction due to the displacement or the inertia of the walking assistance robot 200 is interrupted to suppress or minimize the change of the dynamic load of the walking assistance robot 200. Therefore, a sense of discomfort or fatigue that the walking trainee performing walking training feels owing to the load of the walking assistance robot 200 is reduced, improving the efficiency of walking training. Furthermore, the dynamic compensation part 330 has a simple structure able to compensate for changes to the dynamic load according to the displacement or the inertia of the walking assistance robot 200, thereby simplifying the apparatus and improving the space efficiency.

In the following section, a walking training apparatus according to an embodiment of the present invention will be described.

Referring to FIG. 4, the walking training apparatus according to an embodiment of the present invention includes a counter load system (not shown) applying a counter load to the walking trainee, a walking assistance robot 200 worn on the limb of the walking trainee, and a walking assistance robot load compensation system 300 as shown in FIG. 1-3 supporting the walking assistance robot 200 and compensating for changes to the dynamic load according to the displacement or the inertia of the walking assistance robot 200, and may further include a treadmill 100, a controller (not shown), a frame 500, and a connection member 400.

The treadmill 100 provides a moving floor facing the walking trainee at a home position. Such a treadmill 100 may be operated at a walking speed within a 0.3~3.0 km/h range synchronized to that of walking assistance robot 200 during operation of the walking training apparatus which may be controlled automatically by the controller according to the state of the walking trainee and the object of training. Furthermore, the treadmill 100 may be operated manually by the walking trainee. The treadmill 100 is movable with wheels installed on the bottom, and the position of the apparatus may be fixed via brakes after moving.

The counter load system includes a driver, a main wire, a harness, and a connection bar, thereby applying the counter load to the walking trainee wearing the harness. That is, when the driver pulls the main wire, the connection bar connected to the main wire moves upwards and the harness connected to the connection bar also moves upwards, thereby towing the walking trainee upwards. Accordingly, the load of the walking trainee may be reduced. Alternatively, a counter load weight may be used instead by the driver to cancel out the load of the walking trainee by the load of the counter load weight. However, the counter load system is not limited to the above embodiments, and the counter load may be applied to the walking trainee in various ways.

The walking assistance robot 200 may be formed in a shape being able to be worn on a limb of the walking trainee. For example, walking assistance robot 200 may include a hip joint robot worn on a hip joint, a knee joint robot worn on a knee joint, and an ankle joint robot worn on an ankle joint, among lower body joint, of which only one joint robot may be selected and used by the patient. The walking assistance robot 200 is installed on the limbs of the walking trainee and driven to provide walking assistance to a walking trainee who has trouble walking. Additionally, among the robots of the walking assistance robot 200, a length adjuster (not shown) may be provided to adjust according to the length of the legs of the walking trainee. The length adjuster can adjust automatically to match the body type of the walking trainee. Additionally, a manual fine adjustment of segment length may be possible in case of errors after automatic length adjustment.

The walking assistance robot load compensation system 300 is a walking assistance robot load compensation system able to cancel out the load of the walking assistance robot 200 worn by the walking trainee. The walking assistance robot load compensation system 300 includes a dynamic compensation part 330 compensating for changes to the dynamic load according to the displacement or the inertia of the walking assistance robot 200, and may further include the guide part 320 and the static compensation part 310. Accordingly, the dynamic compensation part 330 may suppress or minimize changes to the dynamic load of the walking assistance robot 200 by the displacement or the inertia of the walking assistance robot 200. Therefore, the sense of discomfort or fatigue that the walking trainee feels owed to the load of the walking assistance robot 200 during walking training is reduced, providing improved efficiency to the walking training. Additionally, the dynamic compensation part 330 has a simple structure and can compensate for changes to the dynamic load according to the displacement or due the inertia of the walking assistance robot 200, thereby simplifying the apparatus and improving the space efficiency.

The controller may control the driving of at least any one of the counter load system, the walking assistance robot 200, the treadmill 100 and the walking assistance robot load compensation system 300 to change the walking condition of the walking trainee, and can generate or store information related to driving. For example, when the speed of the treadmill 100 and a stride range is entered into the controller according to the state of the walking trainee and the training object, the treadmill 100 may operate within the entered range. Furthermore, according to body condition of the walking trainee, by operating the walking assistance robot load compensation system 300, the walking assistance robot 200 may be moved to a height suitable for the walking trainee to wear the walking assistance robot 200.

The frame 500 may support the walking assistance robot 200, the walking assistance robot load compensation system 300, and so on. The connection member 400 is deployed between the walking assistance robot load compensation system 300 and the frame 500 to connect the walking assistance robot load compensation system 300 to the frame 500. That is, a center part of the connection member 400 is connected to the guide body 321 and both end parts to the frame 500. Additionally, the guide body 321 may be engaged to and fixed to the connection member 400. For example, the connection member 400 may be hinge-coupled to the frame 500 at one end, which may pivot to move the walking assistance robot to a wearing position of the walking trainee. That is, at one end of the connection member 400, a hinge part 410 may be provided to be connected to one side of the frame 500 and at the other end a fixing unit 420 is provided to connect to the other side of the frame 500.

The fixing unit 420 may be a latch. Accordingly, when releasing the fixing unit 420, the connection member 400 pivots on the hinge part 410 and the walking assistance robot load compensation system 300 and the walking assistance robot 200 connected to the connection member 400 may be moved together. Therefore, the walking trainee can board the walking training apparatus with ease. Then, when rotating the connection member 400 in opposite direction to lock the fixing unit 420 on the frame 500, the walking assistance robot 200 moves to boarding position for the walking trainee to wear the walking assistance robot 200 with ease to begin training. In reverse, the walking trainee gets off from the walking training apparatus after walking training by releasing the fixing unit 420 and rotating the connection member 400. Thus, the walking trainee may get off from the walking training apparatus with ease.

As mentioned above, though some specific embodiments are described in detailed description of the present invention, various changes may be possible within the scope of the present invention without deviations. Therefore, the scope of the present invention should not be determined in the limitations of the embodiments described above, but should be determined by the claims as well as the equivalents thereof.

What is claimed is:

1. A walking assistance robot load compensation system to cancel out a load of a walking assistance robot worn by a walking trainee, comprising a dynamic compensation part that compensates for a changing dynamic load of the walking assistance robot in a dynamic state where the walking assistance robot moves, wherein the dynamic compensation part comprises:

a first plate connected to a moving block to be moved by the walking assistance robot, and movable in association with the walking assistance robot;

a second plate connected to the moving block to be moved by the walking assistance robot, the second plate spaced apart from the first plate and movable in association with the walking assistance robot;

a connection wire connected to the first and the second plates and movable in association with the first plate and the second plate; and a dynamic compensation unit applying resistance force to the connection wire to suppress the change of the dynamic load of the walking assistance robot, wherein the dynamic compensation unit comprises:

a pulley in contact with the connection wire and to be rotated by the connection wire;

a cam connected to the pulley; and an elastic body which provides frictional force to the cam when rotated, wherein a rotation axis of the cam is deployed eccentrically from a gravity center of cam portion of the cam.

2. The walking assistance robot load compensation system according to claim 1, wherein the dynamic compensation unit further comprises:

a case which receives the cam and the elastic body;

a cover which seals inside of the case; and a lever which adjusts position of the cam, wherein lubricant is provided inside of the case.

3. The walking assistance robot load compensation system according to claim 1, wherein the elastic body comprises a plurality of elastic bodies deployed on an inner wall of a case in two directions crossing at right angles to a rotation axis of the cam.

4. The walking assistance robot load compensation system according to claim 1, further comprising a guide part, wherein the guide part comprises:

a guide body;

a moving block connected to the first plate and the second plate and movably connected to the guide body;

a guide shaft installed on the guide body; and a fixing member connected to the guide shaft to fix a position where the dynamic compensation unit is deployed.

5. The walking assistance robot load compensation system according to claim 4, wherein the fixing member is vertically movable along the extending direction of the guide shaft, wherein the guide part further comprises a position adjuster configured for adjusting a position of the fixing member where the dynamic compensation unit is fixed, and wherein the position adjuster provided with a brake.

6. The walking assistance robot load compensation system according to claim 1, further comprising a static compensation part, wherein the static compensation part comprises:

a wire configured to be connected to the walking assistance robot; and an elasticity unit connected to the wire to apply tensile force constantly to the walking assistance robot to provide static compensation for the walking assistance robot.

7. The walking assistance robot load compensation system according to claim 6, wherein the elasticity unit comprises a spring balancer.

8. A walking training apparatus, comprising:

a walking assistance robot worn on limbs of the walking trainee; and the walking assistance robot load compensation system of claim 1 supporting the walking assistance robot and compensating for a changing dynamic load of the walking assistance robot.

9. The walking training apparatus according to claim 8, wherein the walking training apparatus further comprises:

a frame which supports the walking assistance robot; and a connection member deployed between the walking assistance robot load compensation system and the frame to connect the walking assistance robot load compensation system and the frame.

10. The walking training apparatus according to claim 9, wherein one end of the connection member is hinge-coupled to the frame, and the connection member pivots to move the walking assistance robot to a wearing position of the walking trainee.

11. The walking training apparatus according to claim 8, which further comprises a treadmill which provides a moving floor face to the walking trainee.

* * * * *